United States Patent [19]

Vester

[11] Patent Number: 4,517,996

[45] Date of Patent: May 21, 1985

[54] VENTILATED FILTER AND SMOKE DISPERSING MOUTHPIECE

[75] Inventor: Rudolph P. Vester, Jeffersonville, Ind.

[73] Assignee: Brown & Williamson Tobacco Corporation, Louisville, Ky.

[21] Appl. No.: 478,758

[22] Filed: Mar. 25, 1983

[51] Int. Cl.[3] ..... A24D 3/00

[52] U.S. Cl. ..... 131/339; 131/361; 131/336; 131/344; 131/341

[58] Field of Search ..... 131/198 R, 338-341, 131/336, 344, 361, 210, 216

[56] References Cited

U.S. PATENT DOCUMENTS

| | | | |
|---|---|---|---|
| 2,954,778 | 10/1960 | Lebert | 131/339 |
| 3,179,112 | 4/1965 | Siegenheim | 131/336 |
| 3,630,210 | 12/1971 | Haslam | 131/339 |
| 4,413,641 | 11/1983 | Dwyer et al. | 131/361 |

*Primary Examiner*—V. Millin

*Assistant Examiner*—Gregory Beaucage

*Attorney, Agent, or Firm*—Charles G. Lamb

[57] ABSTRACT

A filter device for a cigarette includes a porous filter rod and a smoke impermeable mouthpiece located at the smoke outlet end of the filter rod. The mouthpiece is formed with a converging nozzle open to the smoke outlet end of the filter rod, and a diverging nozzle, in flow communication with the converging nozzle, open to the outlet or mouth end of the mouthpiece. In addition, a number of smoke flow capillaries are formed generally longitudinally through the mouthpiece. Each smoke flow capillary has an open inlet end open to the smoke outlet end of the filter rod and an open outlet end open to the mouth end of the mouthpiece. A tipping material circumscribes the filter rod and mouthpiece for holding them together and for attaching the filter device to the tobacco column of the cigarette. The tipping material is air permeable over at least a portion of the filter rod.

14 Claims, 3 Drawing Figures

VENTILATED FILTER AND SMOKE DISPERSING MOUTHPIECE

BACKGROUND OF THE INVENTION

1. Field of the Invention

The present invention relates to filters for cigarettes, and more particularly to a filter device for a cigarette which includes a porous filter rod and an impermeable mouthpiece having smoke flow passages therethrough for delivering filtered and ventilated smoke to the smoker's mouth.

2. Description of the Prior Art

It is known in the art to add filters to cigarettes wherein the filters are provided with ventilation means to bring ambient air into the filter to dilute the smoke stream passing therethrough. The dilution of the smoke stream reduces the quantity of smoke particles as well as the gas phase components which are delivered to the smoker's mouth. A number of means have been proposed and are utilized for introducing ventilating air into the cigarette. For example, the wrapper for the tobacco column of a cigarette can be made from a porous material which allows for the introduction of air along the entire length of the tobacco column where it mixes with the smoke stream passing therethrough thereby diluting the smoke in the stream. Also, the cigarette wrapper may be perforated at selected locations along the tobacco column to provide ports in the tobacco column through which ventilating air enters. Even further, it is known to perforate the wrapper or tipping material of the filter at the end of a tobacco column to allow ventilating air to enter the filter and dilute the smoke stream as it is being filtered.

Devices for diluting smoke with ventilating air before the smoke is filtered are also known. One example of such a device is shown in U.S. Pat. No. 3,552,399. The device, therein referred to as a filter for homogenizing air and smoke has a blind ended, longitudinal, central axial passageway. In one embodiment of the filter, the central axial passageway is open to a filter element. A plurality of longitudinal passageways surround and extend parallel to the central passageway, and transverse passageways interconnect the longitudinal passageways and central passageway with each other and with the ambient. As the cigarette to which the device is attached is smoked, smoke and ambient air traverses the longitudinal and central passageways wherein the smoke and air are mixed before being filtered by the filter element.

Devices are also known for delivering unfiltered smoke and ventilating air to the smoker's mouth. For example, U.S. Pat No. 4,023,576 shows a cigarette with a hollow mouthpiece which defines a smoke chamber. The smoke chamber is separated from the tobacco column by two spaced apart baffle plates which define a curved path which the smoke must traverse before entering the smoke chamber. The mouth end of the chamber is closed by a wall having a central orifice for the flow of smoke out of the smoke chamber into the smoker's mouth. The exterior surface of the mouthpiece is provided with longitudinal grooves which cooperate with an overlaying perforated tipping paper to define flow paths for ventilating air. When a smoker draws on the mouthpiece, undiluted, unfiltered smoke is drawn from the tobacco column into the smoke chamber and through the outlet orifice centrally of the mouthpiece and into the smoker's mouth. At the same time, ventilating air is drawn in through the tipping paper and longitudinal grooves to mix with the undiluted smoke within the smoker's mouth.

SUMMARY OF THE INVENTION

The present invention provides a straightforward filter device for a cigarette for filtering cigarette smoke and lowering tar by ventilation. The present invention also provides a filter device for a cigarette which enhances the perceived taste of a cigarette while lowering tar. The present invention even further provides a filter device of the class described which is adapted to provide a pressure drop and, therefore, draw effort corresponding to the draw effort of a conventional filtered cigarette.

More particularly, the present invention provides a filter device for a cigarette comprising a porous filter rod of generally cylindrical configuration having a smoke inlet end and a smoke outlet end; a smoke and air impermeable mouthpiece of generally cylindrical configuration having a smoke inlet end and a mouth end, the mouthpiece being coaxially located with the filter rod and having its smoke inlet end in juxtaposition with the smoke outlet end of the filter rod; tipping material circumscribing the filter rod and mouthpiece and extending longitudinally along the filter rod and mouthpiece from the smoke inlet end of the filter rod to the mouth end of the mouthpiece, the tipping material being air permeable in a zone thereof overlaying at least a portion of the filter rod; means defining a generally conical converging nozzle in the mouthpiece in open smoke flow communication with the smoke outlet end of the filter rod; means defining a generally conical diverging nozzle in the mouthpiece downstream, relative to the direction of smoke flow through the mouthpiece, of the converging nozzle means, the diverging nozzle means being generally coaxial with the converging nozzle means, and the diverging nozzle means having its divergent end open to the mouth end of the mouthpiece; means defining a short smoke flow capillary from the converging nozzle means to the diverging nozzle means; and, means defining a plurality of smoke flow capillaries extending generally longitudinally through the mouthpiece, each of the smoke flow capillaries having an open inlet end open to the smoke outlet end of the filter rod and an open outlet end open to the mouth end of the mouthpiece, the open outlet ends of the smoke flow capillaries being situated in an array about the circumference of the divergent open end of the divergent nozzle means at the mouth end of the mouthpiece, and the open outlet end of each smoke flow capillary being recessed inwardly of the mouth end of the mouthpiece.

BRIEF DESCRIPTION OF THE DRAWINGS

The various features and advantages of the present invention will become clear upon reference to the following description and accompanying drawings wherein like numerals refer to like parts throughout, and in which.

DESCRIPTION OF THE PREFERRED EMBODIMENT

Figure 1:
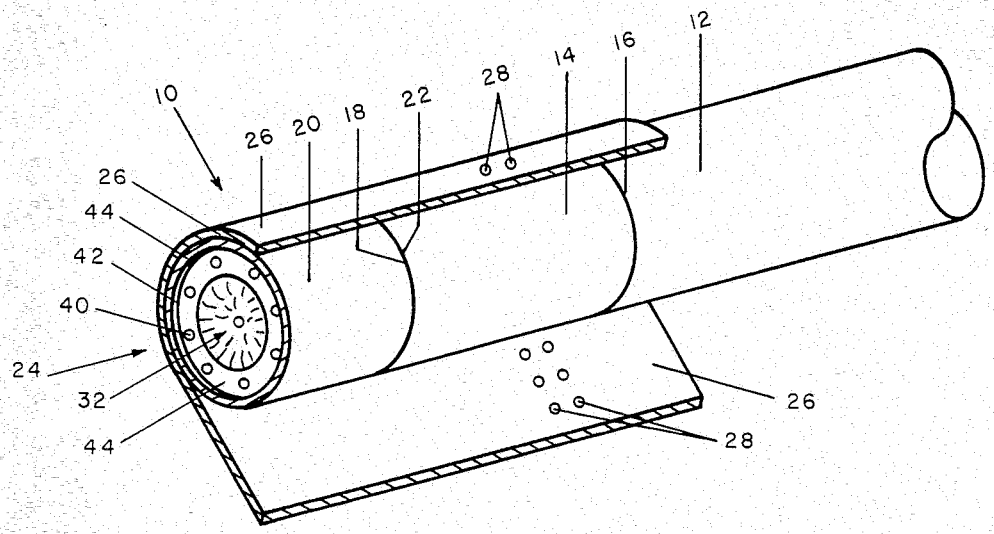
FIG. 1 is a perspective view of the preferred embodiment of the filter device of the present invention attached to a cigarette tobacco column.
Figure 2:
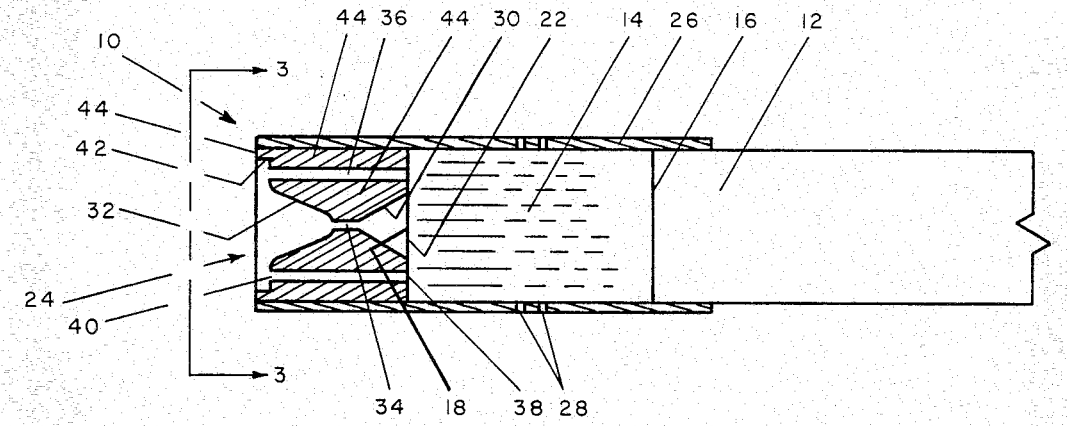
FIG. 2 is a longitudinal cross-sectional view of the filter device of FIG. 1 as viewed in the direction of arrows 2—2 in FIG. 1; and, FIG. 3 is an end view of the filter device of FIG. 2 as viewed in the direction of arrows 3—3 in FIG. 2.

FIGS. 1 and 2 illustrate a cigarette filter device, generally denoted as the numeral 10, incorporating the features of the present invention attached to a tobacco column 12. The filter device 10 is shown as including a generally cylindrical, porous filter rod 14 having a smoke inlet end 16 and a smoke outlet end 18. The porous filter rod 14 is coaxially located at one end of the tobacco column 12 with the inlet end 16 in juxtaposition to the end of the tobacco column 12. The filter rod 14 can be fabricated of virtually any filter material such as, for example, cellulose acetate. The filter device 10 further includes a mouthpiece; generally denoted as the numeral 20, fabricated of an air impermeable material such as, for example, a plastic. The mouthpiece 20 is of generally cylindrical configuration and has a smoke inlet end 22 and a mouth end 24. The mouthpiece 20 has a diameter generally equal to the diameter of the filter rod 14. The mouthpiece 20 is coaxially located with the filter rod 14 with its smoke inlet end 22 in juxtaposition with the smoke outlet end 18 of the filter rod 14. The filter device 10 is shown as being attached to the tobacco column 12 by tipping material 26 which circumscribes the filter device 10 and extends longitudinally thereof from the mouth end 24 of the mouthpiece 20 to the smoke inlet end 16 of the filter rod 14. As shown in FIGS. 1 and 2, the tipping material is partially unwound from its circumscribing position to more clearly expose details of the filter device 10. The tipping material 26 overlaps a portion of the tobacco column 12, thus, attaching the filter device 10 to the tobacco column 12. The tipping material 26 is air permeable in at least a zone thereof overlaying the filter rod. As illustrated, the air permeability of the tipping material 26 is provided by forming small air flow perforations 28 through the thickness of the tipping material 26. However, the air permeability can be accomplished by forming the tipping material 26 of a porous material.

Figure 3:
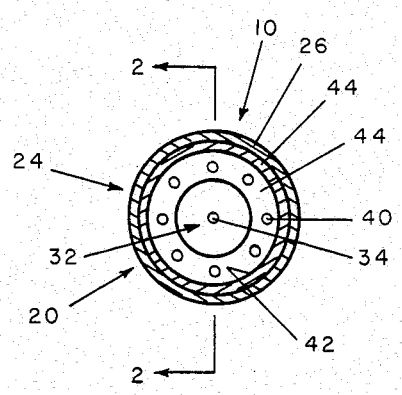

With reference to FIGS. 1 through 3, the mouthpiece 20 is formed with means defining a generally conical converging nozzle 30 and means defining a generally conical diverging nozzle 32 downstream, relative to the flow of smoke through the mouthpiece 20, of the converging nozzle means 30. The convergent nozzle means 30 is in open smoke flow communication with the smoke outlet end 18 of the filter rod 14 and the divergent nozzle means 32 has its divergent end open to the mouth end 24 of the mouthpiece 20. The convergent nozzle means 30 and divergent nozzle means 32 are mutually coaxial and are smoke flow communication at their apices by means defining a short smoke capillary 34.

With continued reference to FIGS. 1 through 3, the mouthpiece 20 further consists of means defining a plurality of smoke flow capillaries 36 extending generally longitudinally through the mouthpiece 20. Each of the longitudinal smoke flow capillaries has an open inlet end 38 open to the smoke outlet end 18 of the filter rod 14 and an open outlet end 40 open to the mouth end 24 of the mouthpiece 20. The outlet ends 40 of the smoke flow capillaries 36 are situated in an array about the circumference of the divergent open end of the divergent nozzle means 32 at the mouth end 24 of the mouthpiece 20. Preferrably, the outlet ends 40 of the smoke flow capillaries 36 are equally, circumferentially spaced from each other. Similarly, the open inlet ends 38 of the smoke flow capillaries 36 are in a circumferentially array about the circumference of the divergent end of the converging nozzle means 30 and are, preferrably, equally, circumferentially spaced from each other. It should be clearly understood that while the figures show eight smoke flow capillaries 36 other numbers can be employed. Further, while the drawings illustrate the smoke flow capillaries 36 as being straight and parallel to the longitudinal axis of the mouthpiece 20, the smoke flow capillaries 36 can, for example, spiral about the longitudinal axis of the mouthpiece 20 as they extend from the inlet end 22 to the mouth end 24. The term longitudinally extending as used herein to describe the smoke flow capillaries 36 means that the smoke flow capillaries 36 traverse the longitude of the mouthpiece 20 regardless of the path they follow.

As illustrated, the outlet ends 40 of the smoke flow capillaries are recessed generally longitudinally inwardly from the mouth end 24 of the mouthpiece 10. Toward this end, a circumferential step 42 radially inwardly facing is formed adjacent to the periphery of the mouthpiece defining a circumferential peripheral flange 44 at the mouth end 24. The outlet ends 40 of the smoke flow capillaries 36 are located in the step 42 radially spaced inwardly of the mouthpiece 20 from the flange 44.

As a smoker draws on the mouth end 24 of the filter device 10, smoke from the tobacco column 12 is drawn into the filter rod 14 through the smoke inlet end 16 and ambient air is drawn into the filter rod 14 through the perforations 28 in the tipping material 26, thus, diluting the smoke as it is being filtered. The greatly diluted, filtered smoke passes out of the filter rod 14 through the smoke outlet end 18 thereof into the smoke flow capillaries 36 through the open ends 38, concurrently, diluted, filtered smoke passes into the converging nozzle means 30 of the mouthpiece 20 from the filter rod 14. As the diluted, filtered smoke moves along the convergent nozzle 30 it is accelerated toward the small capillary 34. The diluted, filtered smoke after passing through the small smoke capillary 34 into the diverging nozzle 32 is decelerated as it flows through the diverging nozzle 32 to the mouth end 24 of the mouthpiece. This causes the filtered, diluted smoke to exit the divergent nozzle 32 in a turbulent flow pattern into the smoker's mouth. Concurrently, the filtered, diluted smoke flows along the smoke flow capillaries 36 exiting the smoke flow capillaries 36 through the open outlets 40 in streams into the smoker's mouth around the turbulent diluted, filtered smoke leaving divergent nozzle 32. The diluted, filtered smoke from the capillaries 36 is, in effect, stirred by the turbulent flow from the diverging nozzle 32 causing wide dispersion of all of the diluted, filtered smoke at the mouth end 24 of the mouthpiece 20 in close proximity to the smoker's "taste buds" resulting in an enhanced perception of taste to the smoker.

The foregoing detailed description is given primarily for clearness of understanding and no unnecessary limitations are to be understood therefrom for modifications will become obvious to those skilled in the art upon reading this disclosure and can be made without departing from the spirit of the invention or scope of the appended claims.

What is claimed is:

1. A filter device for a cigarette comprising:

a porous filter rod of generally cylindrical configuration having a smoke inlet end and a smoke outlet end;

a smoke and air impermeable mouthpiece of generally cylindrical configuration having a smoke inlet end and a mouth end, the mouthpiece being coaxially located with the filter rod and having its smoke inlet end in juxtaposition with the smoke outlet end of the filter rod;

means providing for the flow of ambient ventilating air into the filter rod;

means defining a generally conical converging nozzle in the mouthpiece in open flow communication with the smoke outlet end of the filter rod;

means defining a generally conical diverging nozzle in the mouthpiece downstream, relative to the direction of smoke flow through the mouthpiece, of the converging nozzle means, the diverging nozzle means having its divergent end open to the mouth end of the mouthpiece;

means defining a short smoke flow capillary from the converging nozzle means to the diverging nozzle means; and means defining a plurality of smoke flow capillaries extending generally longitudinally through the mouthpiece, each of the smoke flow capillaries having an open inlet end open to the smoke outlet end of the filter rod and an open outlet end open to the mouth end of the mouthpiece.

2. The filter device of claim 1, wherein the open outlet ends of the smoke flow capillaries are situated in an array about the circumference of the divergent open end of the diverging nozzle means at the mouth end of the mouthpiece.

3. The filter device of claim 2, wherein the open outlet ends of the smoke flow capillaries are equally, circumferentially spaced apart from each other.

4. The filter device of claim 1, wherein the open outlet ends of the smoke flow capillaries are recessed longitudinally, inwardly of the mouthpiece from the mouth end of the mouthpiece.

5. The filter device of claim 4, wherein the mouthpiece comprises a circumferential, peripheral flange at the mouth end defining the recess.

6. The filter device of claim 1, wherein the open inlet ends of the smoke flow capillaries are situated in an array about the circumference of the divergent open end of the converging nozzle means.

7. The filter device of claim 6, wherein the open inlet ends of the smoke flow capillaries are equally, circumferentially spaced apart from each other.

8. The filter device of claim 1, wherein the plane of the outlet open ends of the smoke flow capillaries is substantially coplanar with the plane of the divergent outlet end of the diverging nozzle means at the mouth end of the mouthpiece.

9. A cigarette comprising:

a tobacco column;

a porous filter rod of generally cylindrical configuration having a smoke inlet end and a smoke outlet end, the filter rod being coaxially located at one end of the filter rod with the inlet end of the filter rod in juxtaposition with the end of the tobacco column;

a smoke and air impermeable mouthpiece of generally cylindrical configuration having a smoke inlet and a mouth end, the mouthpiece being coaxially located with the filter rod and having its smoke inlet end in juxtaposition with the smoke outlet end of the filter rod;

means providing for the flow of ambient ventilating air into the filter rod;

means defining a generally conical converging nozzle in the mouthpiece in open flow communication with the smoke outlet end of the filter rod;

means defining a generally conical diverging nozzle in the mouthpiece downstream, relative to the direction of smoke flow through the mouthpiece, of the converging nozzle means, the diverging nozzle means having its divergent end open to the mouth end of the mouthpiece;

means defining a smoke flow capillary from the converging nozzle means to the diverging nozzle means; and, means defining a plurlity of smoke flow capillaries extending generally longitudinally through the mouthpiece, each of the smoke flow capillaries having an open inlet end open to the smoke outlet end of the filter rod and an open outlet end open to the mouth end of the mouthpiece.

10. The cigarette of claim 9, wherein the open outlet ends of the smoke flow capillaries are situated in an array about the circumference of the divergent open end of the diverging nozzle means at the mouth end of the mouthpiece.

11. The cigarette of claim 10, wherein the open outlet ends of the smoke flow capillaries are equally, circumferentially spaced apart from each other.

12. The cigarette of claim 9, wherein the open outlet ends of the smoke capillaries are recessed longitudinally inwardly of the mouthpiece from the mouth end of the mouthpiece.

13. The cigarette of claim 9, further comprising:

tipping material circumscribing the filter rod and mouthpiece and extending longitudinally from the mouth end of the mouthpiece past the smoke inlet end of the filter rod and overlapping a portion of the tobacco column; and, the flow ventilation means into the filter rod is an air permeable zone of the tipping material overlaying the filter rod.

14. The cigarette of claim 10, wherein the zone of air permeability comprises air flow perforations formed through the thickness of the tipping material.

* * * * *